US011867404B2

(12) United States Patent
Fitzgibbins et al.

(10) Patent No.: US 11,867,404 B2
(45) Date of Patent: Jan. 9, 2024

(54) FIRE PIT

(71) Applicant: Oztent Australia Pty. Limited, Wetherill Park (AU)

(72) Inventors: Trent Fitzgibbins, Wetherill Park (AU); Nyein Chan Aung, Wetherill Park (AU)

(73) Assignee: Oztent Australia Pty. Limited, Wetherill Park (AU)

( * ) Notice: Subject to any disclaimer, the term of this patent is extended or adjusted under 35 U.S.C. 154(b) by 332 days.

(21) Appl. No.: 17/330,835

(22) Filed: May 26, 2021

(65) Prior Publication Data

US 2021/0372625 A1 Dec. 2, 2021

(30) Foreign Application Priority Data

May 27, 2020 (AU) ..... 2020901737

(51) Int. Cl.

| | |
|---|---|
| ***F24C 1/16*** | (2021.01) |
| ***F24B 1/26*** | (2006.01) |
| ***F24B 13/00*** | (2006.01) |

(52) U.S. Cl.
CPC ..... *F24C 1/16* (2013.01); *F24B 1/26* (2013.01); *F24B 13/006* (2013.01)

(58) Field of Classification Search
None
See application file for complete search history.

(56) References Cited

U.S. PATENT DOCUMENTS 2,848,982 A * 8/1958 Valentine ..... F23B 50/02 122/368

* cited by examiner

*Primary Examiner* — David J Laux
(74) *Attorney, Agent, or Firm* — Dority & Manning, PA

(57) ABSTRACT

A fire pit comprising a body having a side wall structure. The body further comprises a base plate located adjacent a lower end portion of the side wall structure, and an opening defined by a perimeter of an upper end portion of the side wall structure. Together, the side wall structure and the base plate form a fire pit chamber. The lower end portion of the side walls and the base plate form a collection sump for collecting and retaining ash that is generated during use. The lower portion of two opposite side walls and and the base plate are tapered downwards towards the center of the base plate to facilitate collection of ash.

19 Claims, 8 Drawing Sheets

FIRE PIT

CROSS-REFERENCE TO RELATED APPLICATIONS

This application is based upon and claims the right of priority to Australian Patent Application No. 2020901737 filed on May 27, 2020, the disclosure of which is hereby incorporated by reference herein in its entirety for all purposes.

FIELD

The present invention relates to a fire pit and related methods.

BACKGROUND

Portable fire pits are above ground structures that are typically formed from a fire-resistant material such as metal and are used for heating and cooking in an outdoor environment such as in the backyards, parks, beaches, or campgrounds and the like. Generally, it is desirable that portable fire pits are visually appealing as well as easy to use, clean, and transport.

It is an object of the invention to provide a fire pit that is an alternative to those of the prior art, and is visually appealing and/or easy to use, and/or easy to clean, and/or easy transport.

SUMMARY OF INVENTION

In a first aspect of the invention there is provided a fire pit comprising:

a body comprising a side wall structure formed from one or more side walls, a base portion, and an open end, the side wall structure and base portion defining a fire pit chamber;

wherein the base portion is configurable between a closed position to prevent egress of material (such as ash) from the chamber through the base portion, and an open position to permit egress of material from the chamber through the base portion.

In an embodiment, the base portion comprises first and second plates, the first and second plates having a first end in hinged connection with the body (such as one or more of the side walls, or an adjacent portion of the base portion which adjacent portion is itself in hinged connection with the one or more side walls)to allow the first and second plates to be pivoted toward each other into the closed position and away from each other into the open position, and a second end having a cooperative attachment structure to permit the second end of the first plate to be pivotally connected to the second end of the second plate when in the closed position.

In one or more forms of the above embodiment, the cooperative attachment structure comprises a quick release lock mechanism, the quick release lock mechanism having a locked position in which the second end of the first plate and the second end of the second plate are locked together via the cooperative attachment structures in the closed position, and an unlocked position in which the cooperative attachment structures are not locked together in the closed position; wherein during normal use, upon actuating the quick release lock mechanism from the locked position to the unlocked position, the first and second plates are configured to move to the open position under gravity.

In one or more forms of the above embodiment, each cooperative attachment structure is in the form of hollow barrels and the quick release lock mechanism is in the form of an elongate bolt or pin, the hollow barrels being axially aligned when the first and second plates are in the closed position to receive the elongate bolt or pin therethrough to lock the at least two plates into the closed position. Preferably, the fire pit further comprises the elongate bolt or pin.

In an embodiment, the base portion and the open end are located at opposite ends of the side wall structure.

In an embodiment, the ash collecting region has a tapered structure that tapers toward a central axis of the body and away from the open end, the axis being defined between base portion and the open end.

In one or more forms of the above embodiment, when in the closed position, the tapered structure is in the form of a collection sump for collecting ash produced during use, the collection sump having a low point adjacent the second end of the first plate and the second end of the second plate.

In an embodiment, the body has an expanded configuration for use as a fire pit in which the one or more side walls and the base portion define the fire pit chamber; and a collapsed configuration for storage.

In one or more forms of the above embodiment, the collapsed configuration is a flat pack configuration and the expanded configuration is a pop-up configuration.

In one or more forms of the above embodiment, the side wall structure is formed from a plurality of side walls and each side wall is connected to an adjacent side wall via a hinged connection to permit the body to be arranged into the expanded configuration or the collapsed configuration.

In one or more forms of the above embodiment, the plurality of side walls is four side walls.

In one or more forms of the above embodiment, the base portion is formed from at least two plates:

a first plate having a first end in hinged connection with a first body portion of the body and a second end having a cooperative attachment structure, the first body portion being attached to, or part of, a first side wall of the plurality of side walls; and a second plate having a first end in hinged connection with a second body portion of the body, the second body portion being attached or part of a second side wall of the plurality of side walls, the second side wall being opposite the first side wall, the second plate having a second end having a cooperative attachment structure for pivotal connection with the cooperative attachment structure on the second end of the first plate;

wherein the first plate and the second plate are pivotable about respective first ends in a direction away from one another into the open position and toward one another into the closed position.

In one or more forms of the above embodiment, the plurality of side walls comprises two foldable side walls opposite one another when in the expanded configuration, and configured to be folded upon themselves about respective fold axes when in the collapsed configuration.

It is preferred that the two foldable side walls are each formed from two panels, the two panels in hinged connection to allow each of the two foldable side walls to be folded upon themselves about their respective fold axes It is preferred that neither of the first plate nor the second plate are in hinged connection with the foldable side walls.

It is preferred that the second ends are in pivotable connection about an axis that is coplanar with the fold axes.

In an embodiment, the one or more side walls comprise keyed receiving structure for receiving one or more removably attachable accessories.

In one or more forms of the above embodiment, the one or more removably attachable accessories include a roasting spit structure, a grill plate structure, or a hot plate structure.

In an embodiment, the fire pit chamber comprises an internal seat for receiving a grate.

In one or more forms of the above embodiment, fire pit further comprises a grate for supporting a solid combustible material, the grate having through-holes sized to permit passage of a material, such as ash, therethrough.

In an embodiment, the fire pit comprises a support assembly that, during use, supports the body in a position spaced above the ground.

In one form of the above embodiment, the support assembly is in the form of wire framework In one form of the above embodiment, the fire pit further comprises a ground plate, the ground plate configured to support the fire pit and provide a bund structure to capture material released through the base portion of the fire pit.

In an embodiment, one or more or all of the side walls comprise one or more air vents adjacent the opening and/or adjacent the base.

In a second aspect of the invention, there is provided a method comprising, igniting a fuel within the fire pit cavity of a fire pit according to the first aspect of the invention and/or embodiments thereof and/or forms thereof.

In a third aspect of the invention, there is provided a use of a fire pit according the first aspect of the invention and/or embodiments thereof and/or forms thereof.

BRIEF DESCRIPTION OF DRAWINGS

FIG. 9 is a view of the embodiment of FIG. 1 in (A) an expanded configuration (B) a part-way folded configuration, and (C) a flat-pack configuration for storage.

DESCRIPTION OF EMBODIMENTS

The present invention relates to a fire pit having a quick release lock mechanism to permit an ash collection sump in a lower portion of the fire pit to be quickly and easily opened to remove ash from the fire pit. In preferred forms, the fire pit is collapsible into a flat pack configuration to permit easy storage and transport. In still more forms, the fire pit is configured to permit the attachment of attachments such as grill or hot plates and rotisserie apparatus.

The invention will be described below in relation to one embodiment thereof.

Figure 1:
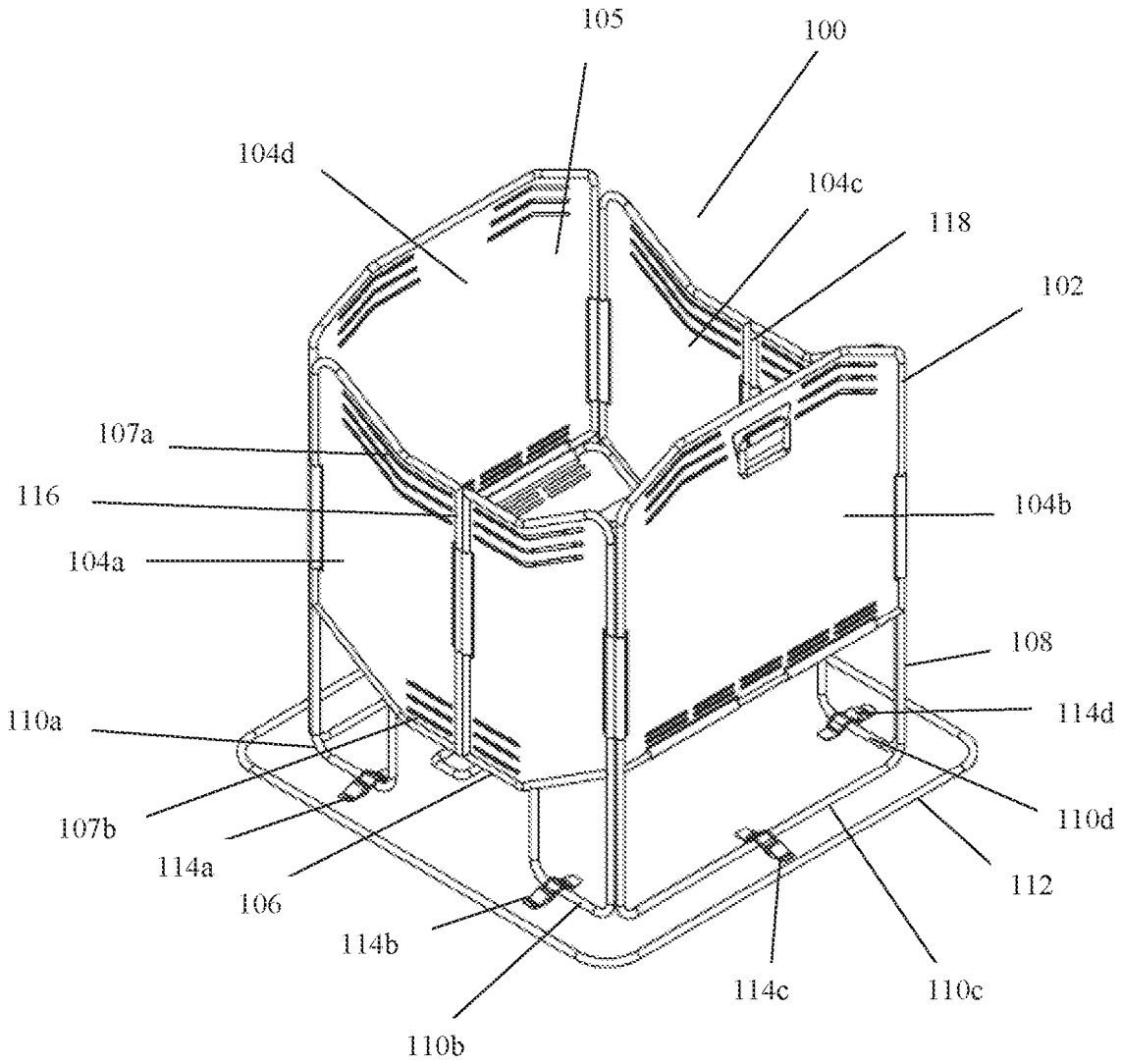
FIG. 1 is a perspective view of a fire pit according to one embodiment of the invention.

FIG. 1 illustrates an embodiment of a fire pit 100 in its usual operating state. The fire pit 100 comprises a body 102 having a side wall structure 104, which in this embodiment has four side walls 104*a*, 104*b*, 104*c*, and 104*d*. The body 102 further comprises a base plate 106 located adjacent a lower end portion of the side wall structure 102, and an opening 105 defined by a perimeter of an upper end portion of the side wall structure 102. Together, the side wall structure 104 and the base plate 106 form a fire pit chamber. The lower end portion of the side walls and the base plate form a collection sump for collecting and retaining ash that is generated during use. In this embodiment, the lower portion of two opposite side walls 104*a* and 104*c* and the base plate are tapered downwards towards the center of the base plate 106 (e.g. in a direction away from the opening and toward the ground surface) to facilitate collection of ash.

The side walls 104*a*, 104*b*, 104*c*, and 104*d*. also include upper air vents 107*a* and lower air vents 107*b* in the lower and upper portions thereof to provide an adequate source of air during use.

The fire pit 100 also comprises a support assembly in the form of in the form of wire framework 108 to which side walls 104*a*, 104*b*, 104*c*, 104*d* and based plate 106 are mounted. The framework 108 includes feet 110*a*, 110*b*, 110*c*, 110*d* (other feet obscured by perspective view) upon which the firepit generally stands. A stand base 112 is also provided which rests directly on the ground. The stand base 112 is a flat structure with securing elements 114*a*, 114*b*, 114*c*, and 114*c* (other securing elements obscured by perspective view) for securing respective feet 110*a*, 110*b*, 110*c*, 110*d* in position to the stand base 112.

Figure 2:
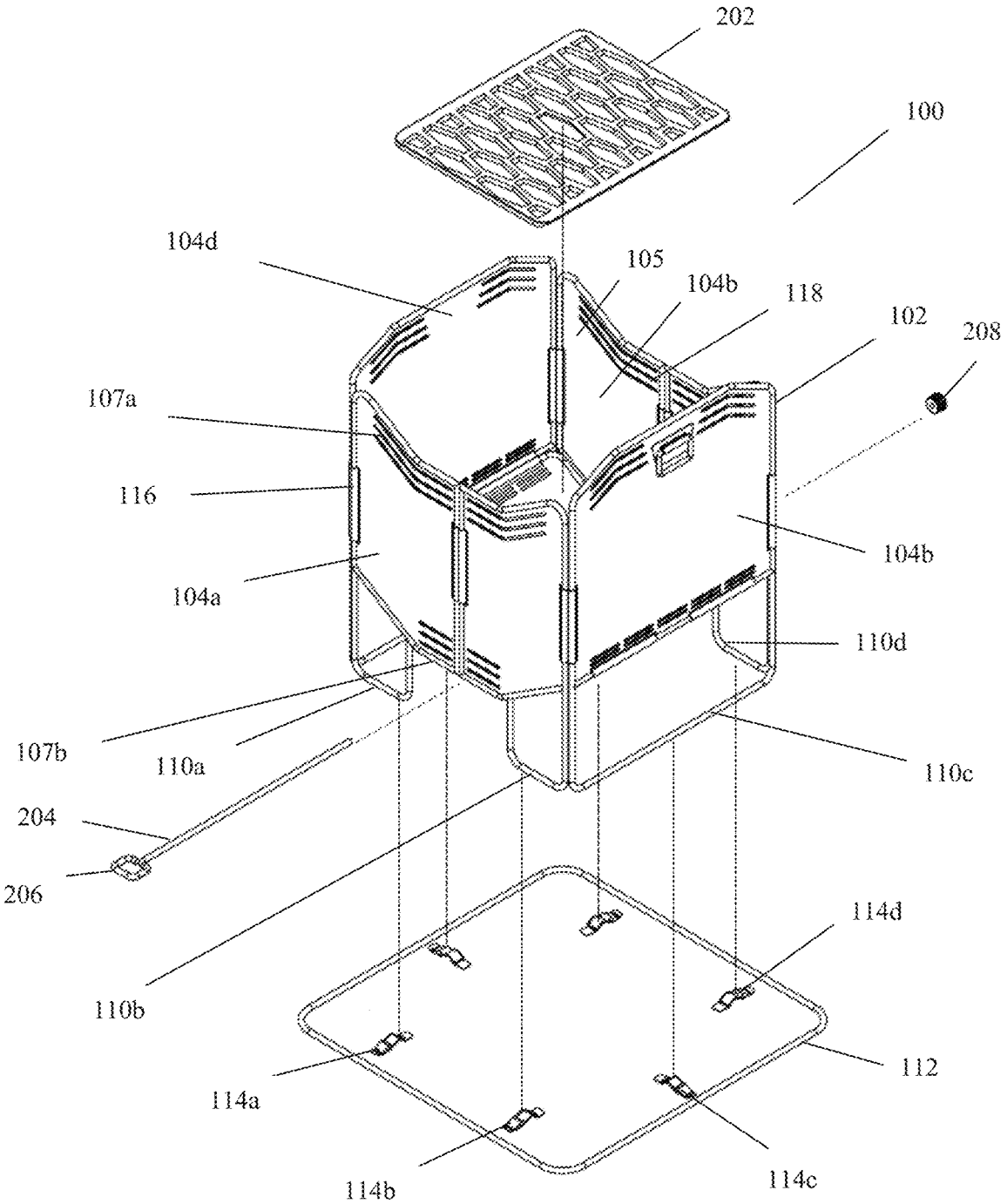
FIG. 2 is an exploded view of the fire pit of FIG. 1.

FIG. 2, which is an exploded view of the fire pit of FIG. 1, shows that a grate 202 formed of a fire-tolerant metal (e.g. cast iron or other suitable metal) is placed within the fire pit chamber when readying the fire pit 100 for use. The grate 202 rests upon a seat within the fire pit 100 above the collection sump. Once the grate 202 is seated within the fire pit 100, combustible material, such as wood, coal, briquettes, paper, and the like are placed on the grate 202 and ignited. The grate 202 also has a number of through-holes which beneficially permit the flow of air from beneath the grate 202 to the combustible material and permits the passage of ash into the collection sump below the grate 202.

Figure 8:
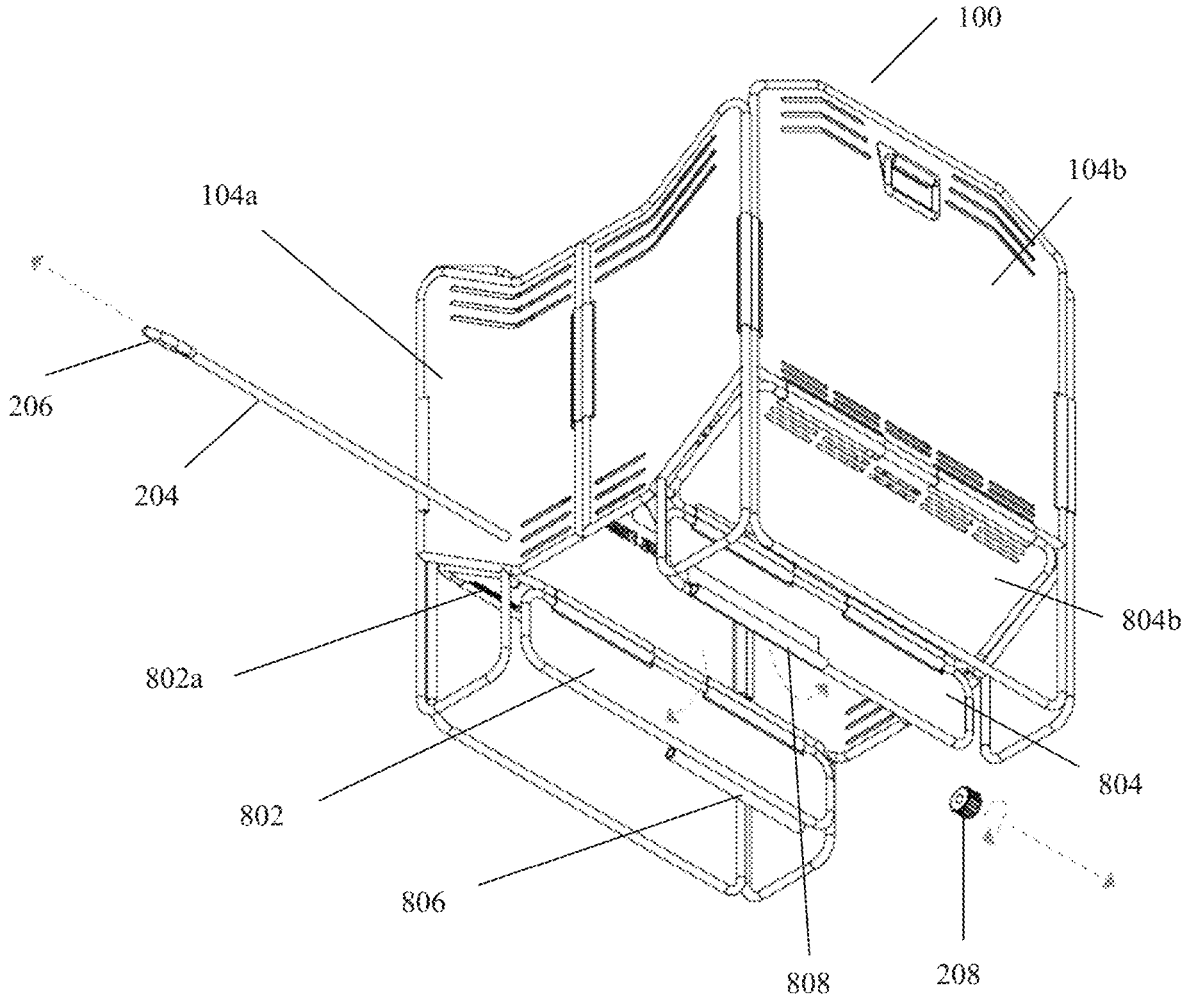
FIG. 8 is a perspective view from below of the embodiment depicted in FIG. 1.
Figure 6:
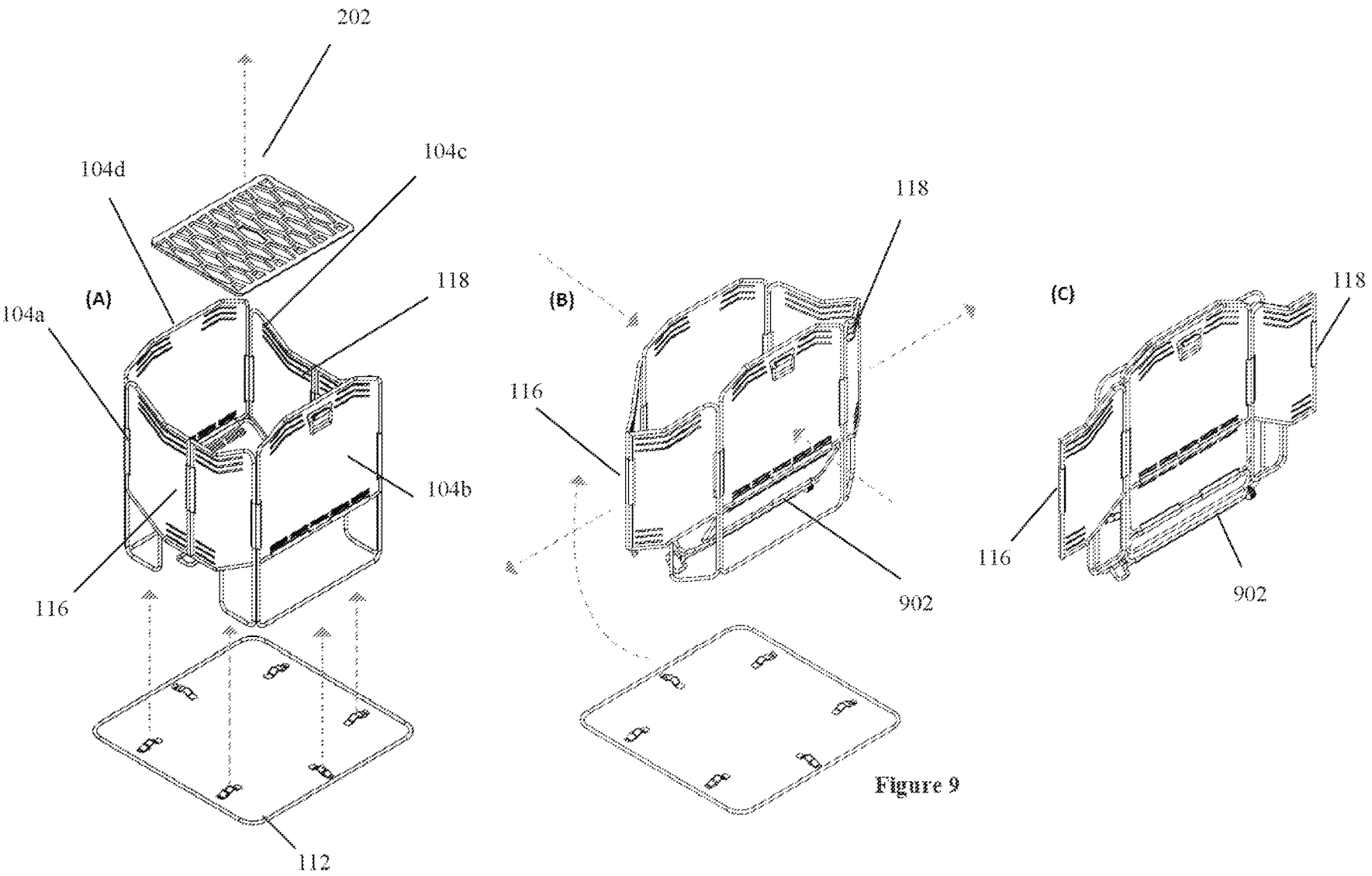

Also illustrated in FIG. 2 is a quick release pin 204 with pull tab 206 on a proximal end and quick release pin fixture 208 on a distal end thereof. Although not shown in FIG. 1 or FIG. 2 (and as best shown in FIG. 8), base plate 106 is formed of two separable plates, a first plate 802 and a second plate 804. First plate 802 is pivotally attached at a first end thereof indirectly to side wall 104*b* via a first angled plate 802*a* and second plate 804 is pivotally attached at a first end thereof to opposite side wall 104*d* via a second angled plate 804*b*. In this way the base plate may be moved into an open position by pivoting the first and second plates 802,804 away from each other, and into a closed position by pivoting the first and second plates toward each other 802,804. In the closed position, second ends of the first and second plates are in contact. Each of the second ends comprises a cooperative attachment structure 806,808 which permits the first and second plates to be locked together in the closed position. Specifically, in this embodiment (see FIG. 8) the cooperative structure is in the form of hollow barrels 806, 808 which are brought into axial alignment when placed in the closed position. Quick release pin 204 is inserted through the hollow barrels which lock the first and second plates together in a similar manner to a latch and barrel lock. The quick release pin fixture 208 can then be secured to the distal end of the quick release pin 204 as a safety mechanism to prevent inadvertent withdrawal of the quick release pin 204 and opening of the base plate 106.

For avoidance of doubt, the base plate 106 should be in the closed position during operation so that any ash that formed during operation is retained in the collection sump. However, after operation, and once the ash is cooled, a user can easily withdraw the quick release pin 204, which causes the base plate 106 to open under the influence of gravity. Specifically, once quick release pin 204 is removed, the first and second plates pivot under gravity or user action into the open position. Any ash retained within the collection sump region then falls from the collection sump region onto stand base 112. The ash can then be easily disposed of. This arrangement offers a significant advantage over prior art fire pits, which generally require ash to be removed through the upper opening such as by picking up the fire pit and inverting the fire pit to tip the ash out.

Another feature of the present embodiment, as illustrated in FIG. 9, is that the fire pit 100 has an expanded configuration (see FIG. 9(A)) for use as a fire pit and a collapsed configuration, and in particular a flat pack configuration, for storage (see FIG. 9(C)). This is achieved in the present embodiment, in part, by connecting side walls 104*a*, 104*b*, 104*c*, 104*d* and base portion 106 together in pivotal manner, in particular, via wire framework 108. In addition to this, opposing side walls 104*a* and 104*c* are each formed from two portions with a fold axis 116, 118 therebetween. In this way, side walls 104*a* and 104*c* can be collapsed upon themselves about their respective fold axis 116,118 (see FIG. 9(B)). In combination with this, and as discussed above, the base portion 106 is formed from first and second plates which are, at the first end pivotally connected to side walls 104*b* and 104*d* respectively and at the second end are in locked together via the cooperative structure and quick release pin 204. However, this locking arrangement permits the first and second plates 802.804 to pivot relative to each other about a pivot axis 902 defined by quick release pin 204. The fold axes 116,118 and the pivot axis 902 are coplanar which allows the fire pit 100 to be collapsed into the flatpack configuration by moving side walls 104*a* and 104*c* toward each other which causes the simultaneous folding of side walls 104*b* and 104*d* about their respective fold axes and the folding of the baseplate 106 about the pivot axis 902. To revert the firepit 100 back to its expanded or pop-up configuration (see FIG. 9(A)), side walls 104*a* and 104*c* can be moved apart (e.g. opposite to what is depicted in FIG. 9(B)) which in turn unfolds side walls 104*b* and 104*d* and baseplate 106.

Figure 10:
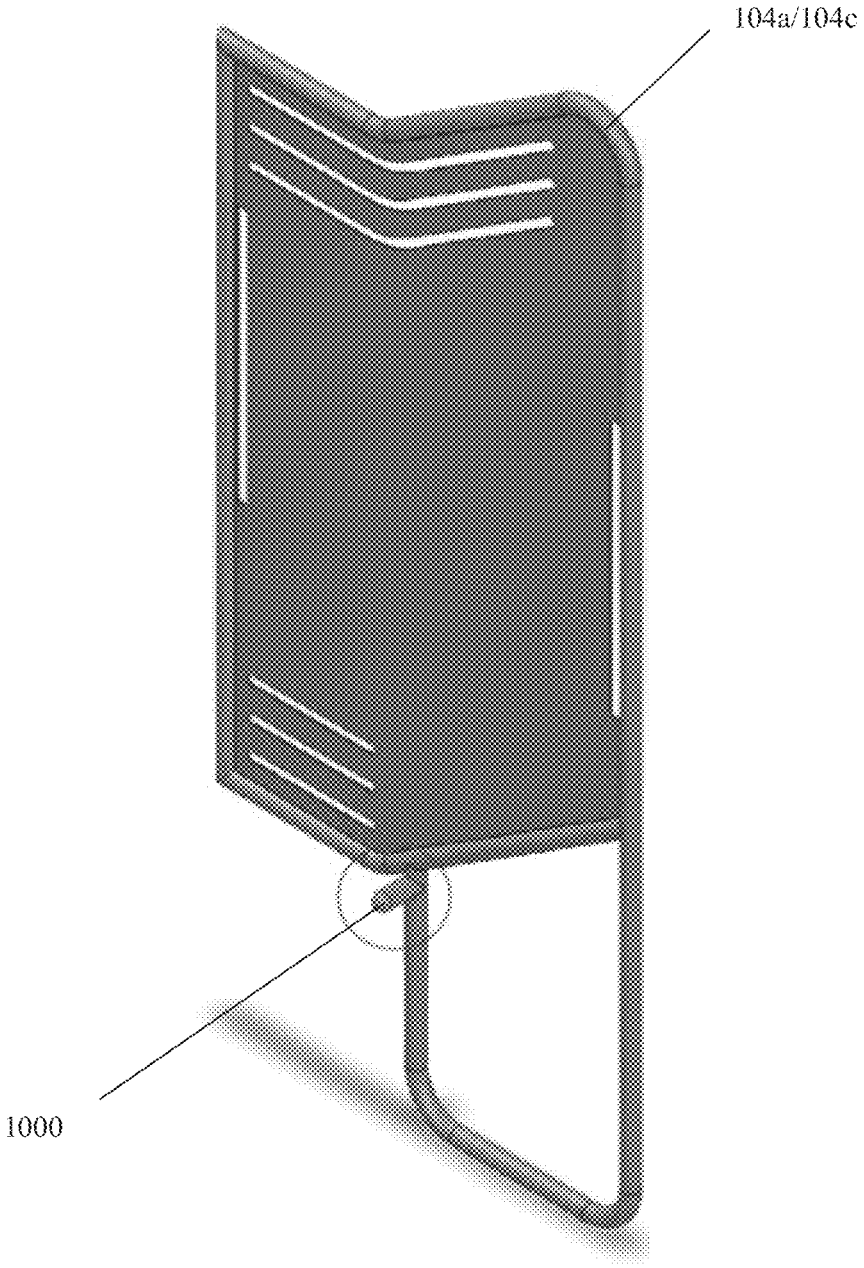
FIG. 10 is a close-up view of a panel of a wall of the embodiment of FIG. 1.

FIG. 10 illustrates a side wall portion, such as of side walls 104*a* or 104*c*, and in particular shows a support tip 1000 in the form of downwardly projecting domed tip to support a respective angled plate 802*a* or 804*b* when the fire pit 100 is in the expanded configuration, and to permit the respective angled plate 802*a* or 804*b* to slide over the tip when fire pit is moved between the expanded and collapsed configurations (see FIG. 9).

Figure 3:
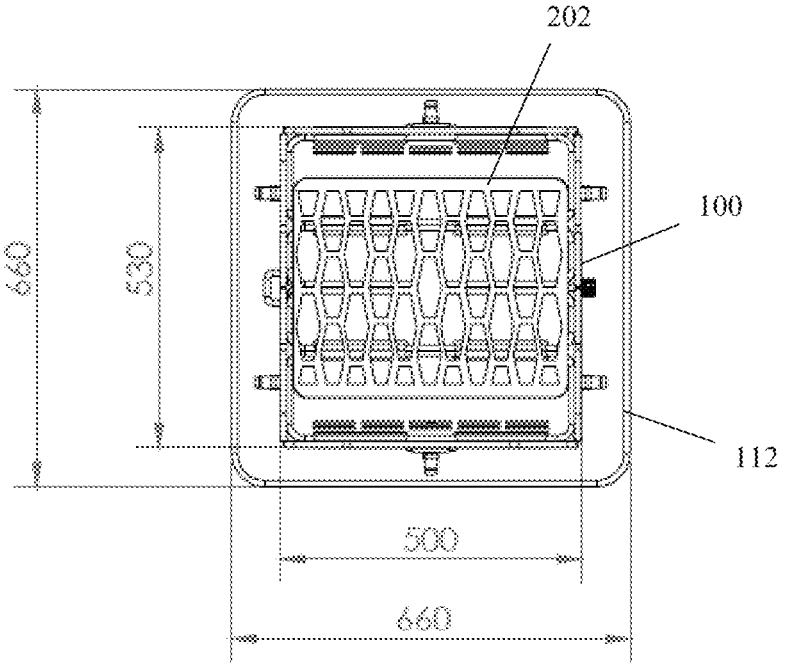
FIG. 3 is a top down plan view of the fire pit of FIG. 1.

FIG. 3 is a top down plan view of the fire pit in the expanded configuration showing the placement of grate 202 within the fire pit chamber.

Figure 4:
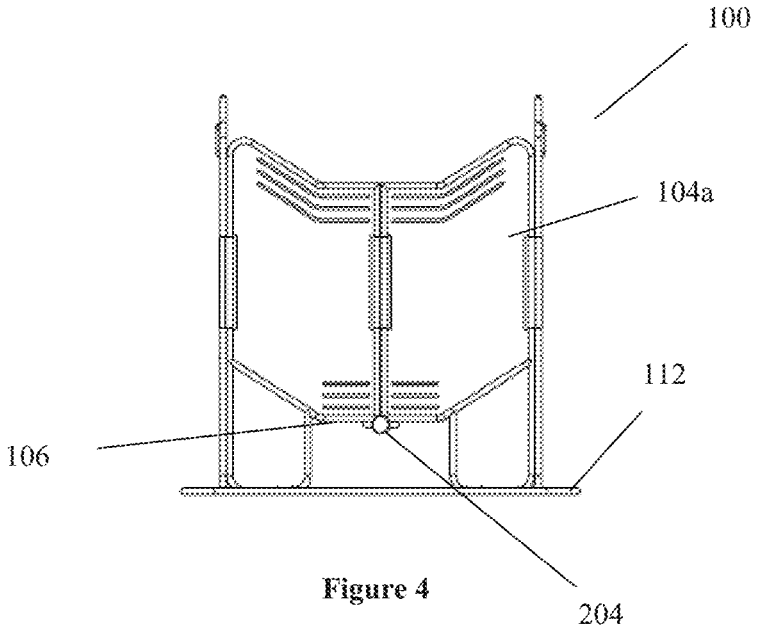
FIG. 4 is a first side plan view of the fire pit of FIG. 1.

FIG. 4 is a side plan view of the fire pit 100 in the expanded configuration showing side wall 104*a* and a side view of the collection sump with the base plate 106 in the closed position, and in particular the first plate X02 of based plate 106.

Figure 5:
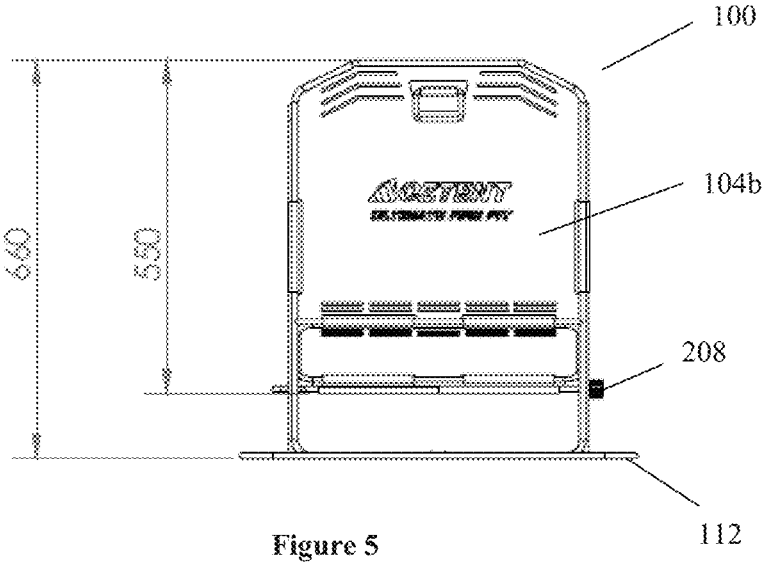
FIG. 5 is a second side plan view of the fire pit of FIG. 1.

FIG. 5 is a side plan view of the fire pit 100 in the expanded configuration showing side wall 104*b* and a profile view of the collection sump with the base plate 106 in the closed position, and in particular the first plate 802 and second plate 804 a of base plate 106 locked in position with the quick release pin 204.

Figure 6:
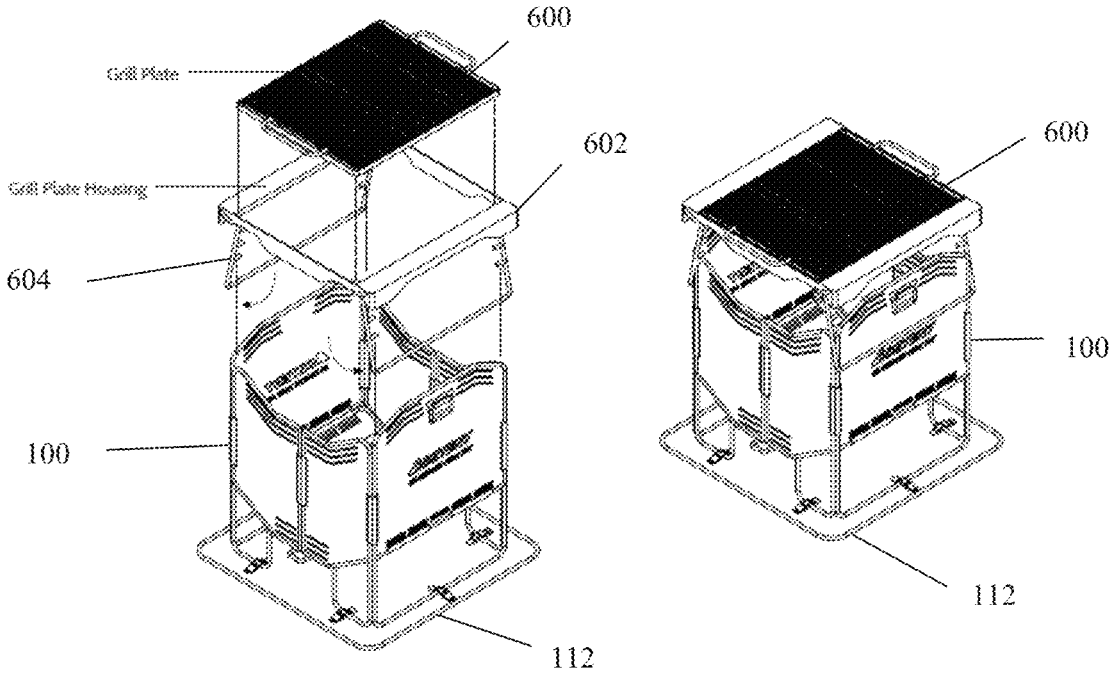
FIG. 6 provides exploded and perspective view of the fire pit of FIG. 1 with a grill plate accessory attached thereto.
Figure 7:
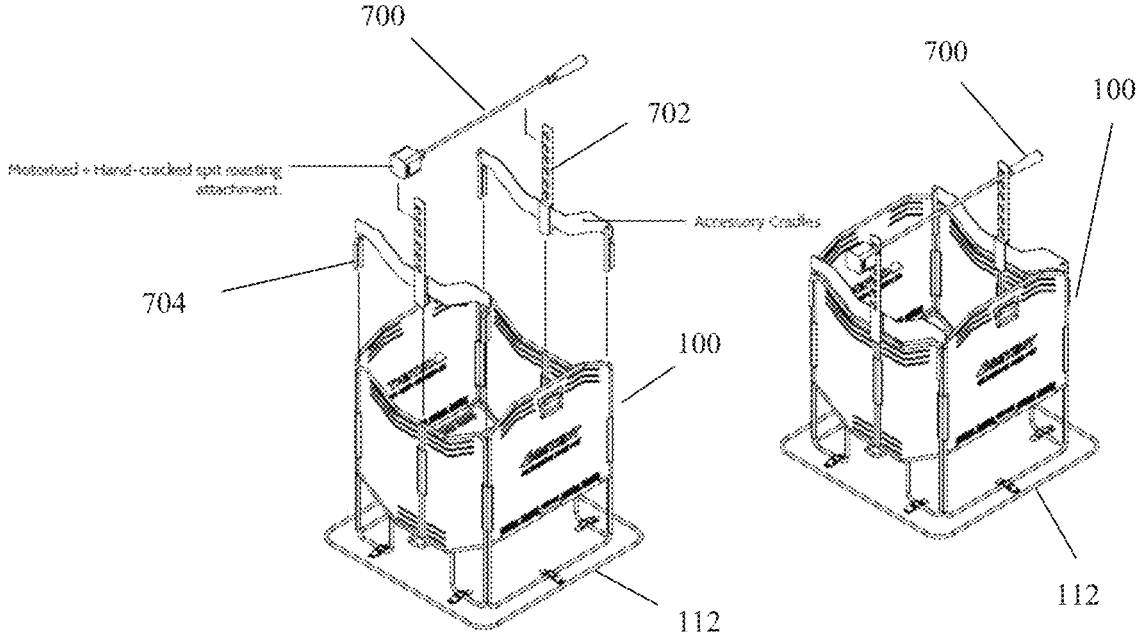
FIG. 7 provides exploded and perspective view of the fire pit of FIG. 1 with a rotisserie accessory attached thereto.

In the depicted embodiment, the fire pit 100 also comprises receiving structure for the attachment of one or more removably attachable accessories. The receiving structure may be in the form of a support surface, for receiving the accessory via a clip or mount on the accessory, or a keyed surface which interacts with a key component on the accessory. FIG. 6 and FIG. 7 are exploded and collapsed views of grill accessory 600 and a spit roasting accessory 700 mounted to a support housing 602 and 702 respectively which is attached to a corresponding support surface on the fire pit via a ratchet type arrangement 604 and clips 704 respectively. The skilled person will appreciate that other mounting structures or types may be used and likewise other accessories may be attached to the fire pit 100.

The invention claimed is:

1. A fire pit comprising:

a body comprising a side wall structure formed from one or more side walls, a base portion having an ash collecting region, and an open end, the side wall structure and base portion defining a fire pit chamber;

wherein the ash collecting region is configurable between a closed position to prevent egress of ash from the ash collecting region through the base portion, and an open position to permit egress of ash from the ash collecting region through the base portion and wherein the base portion comprises first and second plates, the first and second plates having a first end in hinged connection with the body to allow the first and second plates to be pivoted toward each other into the closed position and away from each other into the open position, and a second end having a cooperative attachment structure to permit the second end of the first plate to be pivotally connected to the second end of the second plate in the closed position.

2. The fire pit of claim 1, wherein the cooperative attachment structure comprises a quick release lock mechanism, the quick release lock mechanism having a locked position in which the second end of the first plate and the second end of the second plate are locked together via the cooperative attachment structures in the closed position, and an unlocked position in which the cooperative attachment structures are not locked together in the closed position; wherein during normal use, upon actuating the quick release lock mechanism from the locked position to the unlocked position, the first and second plates are configured to move to the open position under gravity.

3. The fire pit of claim 2, wherein each cooperative attachment structure is in the form of hollow barrels and the quick release lock mechanism is in the form of an elongate bolt or pin, the hollow barrels being axially aligned when the first and second plates are in the closed position to receive the elongate bolt or pin therethrough to lock the at least two plates into the closed position.

4. The fire pit of claim 1, wherein the base portion and the open end are located at opposite ends of the side wall structure.

5. The fire pit of claim 1, wherein the ash collecting region has a tapered structure formed from the first and second plates that tapers toward a central axis of the body and away from the open end, the axis being defined between base portion and the open end.

6. The fire pit of claim 5, wherein, when in the closed position, the tapered structure is in the form of a collection sump for collecting ash produced during use, the collection sump having a low point adjacent the second end of the first plate and the second end of the second plate.

7. The fire pit of claim 1, wherein the body has an expanded configuration for use as a fire pit in which the one or more side walls and the base portion define the fire pit chamber; and a collapsed configuration for storage.

8. The fire pit of claim 7, wherein the collapsed configuration is a flat pack configuration and the expanded configuration is a pop-up configuration.

9. The fire pit of claim 8, wherein the side wall structure is formed from a plurality of side walls and each side wall is connected to an adjacent side wall via a hinged connection to permit the body to be arranged into the expanded configuration or the collapsed configuration.

10. The fire pit of claim 9, wherein the plurality of side walls is four side walls.

11. The fire pit of claim 7, wherein the base portion is formed from at least two plates:

a first plate having a first end in hinged connection with a first body portion of the body and a second end having a cooperative attachment structure, the first body portion being attached to, or part of, a first side wall of the plurality of side walls; and a second plate having a first end in hinged connection with a second body portion of the body, the second body portion being attached or part of a second side wall of the plurality of side walls, the second side wall being opposite the first side wall, the second plate having a second end having a cooperative attachment structure for pivotal connection with the cooperative attachment structure on the second end of the first plate;

wherein the first plate and the second plate are pivotable about respective first ends in a direction away from one another into the open position and toward one another into the closed position.

12. The fire pit of claim 11, wherein the plurality of side walls comprises two foldable side walls opposite one another when in the expanded configuration, and configured to be folded upon themselves about respective fold axes when in the collapsed configuration.

13. The fire pit of claim 12, wherein the two foldable side walls are each formed from two panels, the two panels in hinged connection to allow each of the two foldable side walls to be folded upon themselves about their respective fold axes.

14. The fire pit of claim 12, wherein, the second ends are in pivotable connection about an axis that is coplanar with the fold axes.

15. The fire pit of claim 11, wherein neither of the first plate nor the second plate are in hinged connection with the foldable side walls.

16. The fire pit of claim 1, wherein the one or more side walls comprise keyed receiving structure for receiving one or more removably attachable accessories.

17. The fire pit of claim 16, wherein the one or more removably attachable accessories include a roasting spit structure, a grill plate structure, or a hot plate structure.

18. The fire pit of claim 1, wherein the fire pit chamber comprises an internal seat for receiving a grate.

19. The fire pit of claim 1, wherein the fire pit comprises one or more of: a support assembly that, during use, supports the body in a position spaced above the ground; a ground plate, the ground plate configured to support the fire pit and provide a bund structure to capture material released through the base portion of the fire pit; one or more air vents disposed in each or one or more of the side walls adjacent the opening and/or adjacent the base.

* * * * *